US009209547B2

(12) United States Patent
Lozano Villarreal et al.

(10) Patent No.: US 9,209,547 B2
(45) Date of Patent: Dec. 8, 2015

(54) CONNECTOR ADAPTER

(75) Inventors: Cesar Lozano Villarreal, Sunnyvale, CA (US); Jim Smeenge, San Jose, CA (US); Chiew-Sang Goh, San Jose, CA (US)

(73) Assignee: Apple Inc., Cupertino, CA (US)

( * ) Notice: Subject to any disclaimer, the term of this patent is extended or adjusted under 35 U.S.C. 154(b) by 681 days.

(21) Appl. No.: 13/492,608

(22) Filed: Jun. 8, 2012

(65) Prior Publication Data

US 2013/0328484 A1 Dec. 12, 2013

(51) Int. Cl.

| | |
|---|---|
| ***H01R 13/62*** | (2006.01) |
| ***H01R 13/24*** | (2006.01) |
| ***H01R 13/66*** | (2006.01) |
| ***H01R 13/717*** | (2006.01) |
| ***H01R 31/06*** | (2006.01) |

(52) U.S. Cl.

CPC ..... *H01R 13/2421* (2013.01); *H01R 13/6205* (2013.01); *H01R 13/6666* (2013.01); *H01R 13/7175* (2013.01); *H01R 31/065* (2013.01); *Y10T 29/49222* (2015.01)

(58) Field of Classification Search

CPC ..... H01R 13/2421; H01R 13/6205

See application file for complete search history.

(56) References Cited

U.S. PATENT DOCUMENTS

| | | | | |
|---|---|---|---|---|
| 4,707,044 | A | 11/1987 | Burns | |
| 7,264,479 | B1 | 9/2007 | Lee | |
| 8,172,580 | B1 * | 5/2012 | Chen et al. | 439/39 |
| 8,241,043 | B1 * | 8/2012 | Lin | 439/39 |
| 8,387,466 | B2 * | 3/2013 | Shinohara et al. | 73/756 |
| 8,727,326 | B2 * | 5/2014 | Lin | 269/8 |
| 2010/0240229 | A1 | 9/2010 | Firman, II et al. | |
| 2013/0040470 | A1 * | 2/2013 | Gao et al. | 439/39 |
| 2013/0328484 | A1 * | 12/2013 | Villarreal et al. | 315/127 |
| 2014/0220793 | A1 * | 8/2014 | Yen | 439/39 |

FOREIGN PATENT DOCUMENTS

| | | | |
|---|---|---|---|
| CN | 2772073 | Y | 4/2006 |
| DE | 202008014989 | U1 | 1/2009 |
| DE | 10 2008 038641 | A1 | 3/2009 |
| WO | 2011/136498 | A2 | 11/2011 |
| WO | 2011/136498 | A3 | 11/2011 |

OTHER PUBLICATIONS

Invitation to Pay Additional Fees mailed on Aug. 26, 2013 for PCT Patent Application No. PCT/US2013/044495, 5 pages.

International Search Report and Written Opinion mailed on Nov. 11, 2013 for PCT Patent Application No. PCT/US2013/044495, 19 pages.

Chinese Office Action mailed on Mar. 25, 2015 for CN Patent Application No. 201310374122.2, with English translation, 13 pages.

* cited by examiner

*Primary Examiner* — James Harvey

(74) *Attorney, Agent, or Firm* — Kilpatrick Townsend & Stockton LLP

(57) ABSTRACT

Connector adapters that may allow contacts in a connector insert to form electrical connections with contacts in an incompatible connector receptacle. One example may provide a connector adapter for providing a connection between a connector insert and an incompatible connector receptacle. The connector adapter may be a magnetic connector providing a magnetic connector receptacle at a first end to accept a connector insert having an attraction plate. This connector adapter may further provide a connector insert having an attraction plate at a second end to insert into a magnetic connector receptacle on an electrical device.

20 Claims, 10 Drawing Sheets

CONNECTOR ADAPTER

BACKGROUND

The number and types of electronic devices available to consumers have increased tremendously the past few years, and this increase shows no signs of abating. Devices such as portable computing devices, tablet, desktop, and all-in-one computers, cell, smart, and media phones, storage devices, portable media players, navigation systems, monitors and other devices have become ubiquitous.

These devices often receive and provide power and data using various cable assemblies. These cable assemblies may include connector inserts, or plugs, on one or more ends of a cable. The connector inserts may plug into connector receptacles on electronic devices, thereby forming one or more conductive paths for signals and power.

The connector receptacles may be formed of housings that typically at least partially surround, and provide mechanical support for, a number of contacts. These contacts may be arranged to mate with corresponding contacts on the connector inserts or plugs to form portions of electrical paths between devices.

Typically, a connector insert is inserted into a compatible connector receptacle to form the one or more conductive paths for signals and power. On occasion, it may be desirable to mate a connector insert with an incompatible connector receptacle. The reasons for this may be many. One or more physical aspects of the connectors may change. For example, a succeeding generation of connectors may become smaller, leaving them incompatible with earlier versions. Also, one or more electrical aspects may change. For example, a number of contacts, signal definitions, or other electrical aspects may change over time. This may leave a user who has purchased a new electronic device with a legacy cable insert and a newer, incompatible connector receptacle.

Thus, what is needed are circuits, methods, and apparatus that may allow contacts in a connector insert to form electrical connections with contacts in an incompatible connector receptacle.

SUMMARY

Accordingly, embodiments of the present invention may provide circuits, methods, and apparatus that may allow contacts in a connector insert to form electrical connections with contacts in an incompatible connector receptacle.

An illustrative embodiment of the present invention may provide a connector adapter for providing a connection between a connector insert and an incompatible connector receptacle. The connector adapter may be a magnetic connector providing a magnetic connector receptacle at a first end to accept a connector insert having an attraction plate. This connector adapter may further provide a connector insert having an attraction plate at a second end to insert into a magnetic connector receptacle on an electrical device.

Another illustrative embodiment of the present invention may provide a connector adapter including a subassembly. This subassembly may include a first housing portion including a mesa formed around a first number of contact pins. The subassembly may further include a second housing portion, where a first number of spring-loaded contacts may be inserted into passages in the second housing. Tail portions of the contact pins may be soldered or otherwise electrically connected to tail portions of corresponding spring-loaded contacts.

Another illustrative embodiment of the present invention may provide a connector adapter having a housing with a face plate at a first opening and an attraction plate at a second opening. Locking clips may be used to fix the attraction plate to the housing. One or more magnets may be located between the face plate and a backup plate. A spring washer may be located between the backup plate and the attraction plate. A subassembly may be located in openings in the face plate, magnets, backup plate, spring washer, and attraction plate.

Another illustrative embodiment of the present invention may provide a connector adapter having a different pitch between contacts in a receptacle side and contacts in an insert side. Tail portions of the contacts in a first one of the sides may be wide relative to tail portions of contacts in a second, other side. To compensate for the difference in pitch, tail portions of the contacts in the second side may connect to tail portions of the contacts in the first side at different locations. Also, contacts in the first side may be located ahead of other contacts in the first side by forming connections with contacts in the second side at different depths.

Another illustrative embodiment of the present invention may provide a cable assembly having receptacle and insert housings connected through a cable. The receptacle and insert housings may include current limiting devices, bypass transistors, light-emitting diodes, current sources, microcontrollers, and other circuitry.

Embodiments of the present invention may be used to provide connector adapters between various interfaces, such as those compatible with MagSafe, DisplayPort, Thunderbolt, the various Universal Serial Bus interfaces and standards, including USB, USB2, and USB3, as well as High-Definition Multimedia Interface (HDMI), Digital Visual Interface (DVI), power, Ethernet, and other types of interfaces and standards. These connector adapters may be utilized with many types of devices, such as portable computing devices, tablet, desktop, and all-in-one computers, cell, smart, and media phones, storage devices, portable media players, navigation systems, monitors and other devices.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
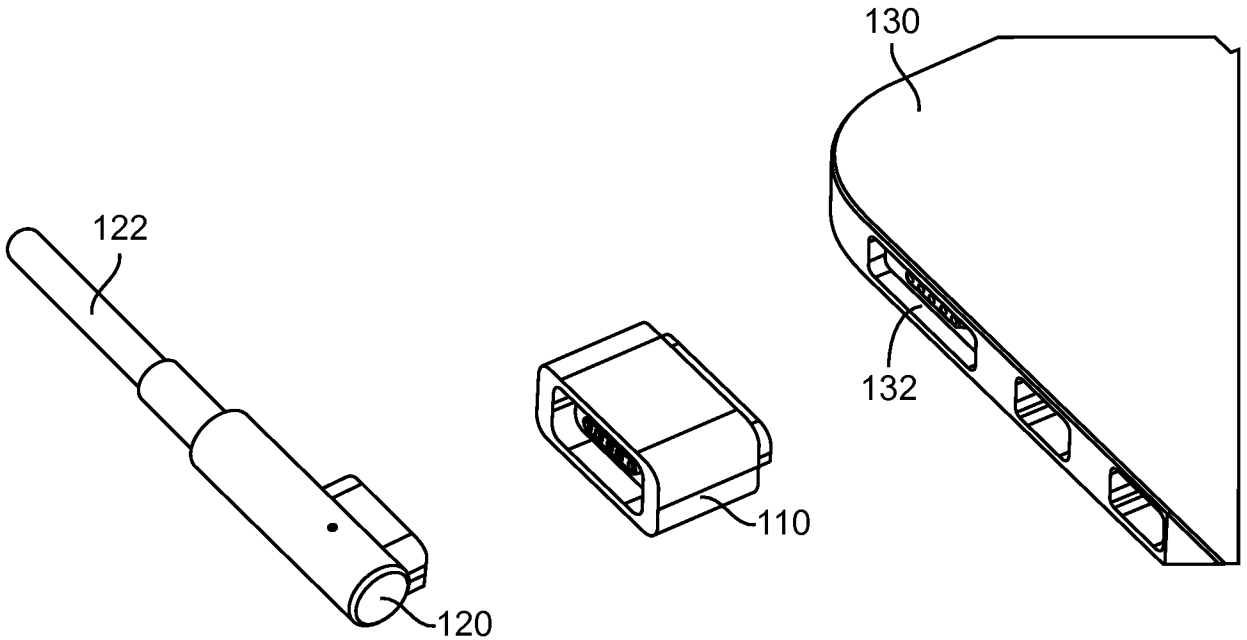
FIG. 1 illustrates an electronic connector system employing a connector adapter according to an embodiment of the present invention.

FIG. 1 illustrates an electronic connector system employing a connector adapter according to an embodiment of the present invention. This figure, as with the other included figures, is shown for illustrative purposes and does not limit either the possible embodiments of the present invention or the claims.

In this example, a user may desire to insert connector insert 120 into an incompatible connector receptacle 132 in device 130. Accordingly, connector adapter 110 may be used to form a connection between connector insert 120 and connector receptacle 132.

In this example, connector adapter 110 may be a magnetic connector adapter. Connector adapter 110 may provide magnetic attraction for an attraction plate on connector insert 120, which may be connected to cable 122. Similarly connector receptacle 132 may provide magnetic attraction for an attraction plate on connector adapter 110. In a specific embodiment of the present invention, the magnetic attraction between connector insert 120 and connector adapter 110 may be stronger than the magnetic attraction between connector adapter 110 and connector receptacle 132. This may help ensure that when connector insert 120 is disengaged from electronic device 130, for example by a nonaxial force, connector adapter 110 may remain in contact with connector insert 120. This may help prevent connector adapter 110 from becoming lost or misplaced, for example when the electronic device 130 is placed in a carrying bag. In other embodiments of the present invention, the magnetic attraction between connector insert 120 and connector adapter 110 may be weaker than the magnetic attraction between connector adapter 110 and connector receptacle 132.

The incompatibility between connector insert 120 and connector receptacle 132 may arise for various reasons. Physical form factors of either connector insert 120 or connector receptacle 132 may change over time. For example, connector receptacle 132 may become smaller or thinner in later generations to provide connector receptacles for very thin devices. Also, in some instances, it may be undesirable to replace connector insert 120 and its cable. For example, connector insert 120 and its cable may be tethered cable assembly, connected directly to a second electronic device (not shown). In a specific embodiment of the present invention, connector insert 120 may be connected to a tethered cable of a display device.

In this specific example, connector insert 120 and connector receptacle 132 may be MagSafe, Thunderbolt, or DisplayPort connector receptacles. In other embodiments of the present invention, other types of connector insets and receptacles may be connected using embodiments of the present invention. These may include the various USB standards, as well as High-Definition Multimedia Interface (HDMI), Digital Visual Interface (DVI), power, Ethernet, and other types of interfaces and standards.

Device 130 may be representative of many types of devices, such as portable computing devices, tablet, desktop, and all-in-one computers, cell, smart, and media phones, storage devices, portable media players, navigation systems, monitors and other devices.

Figure 2:
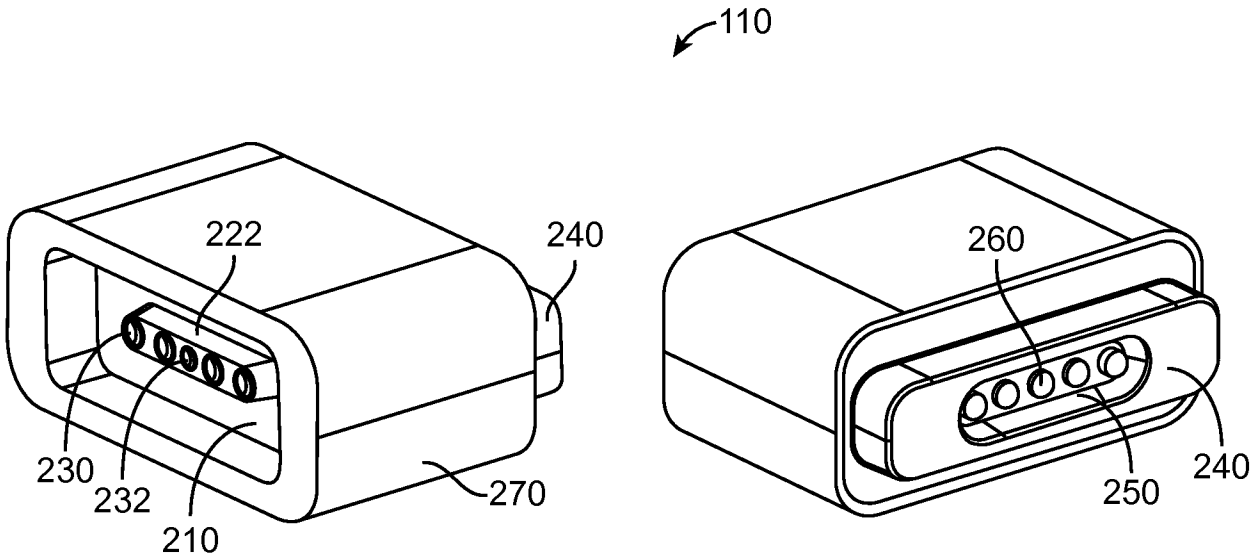
FIG. 2 illustrates a more detailed view of the back and front sides of a connector adapter according to an embodiment of the present invention.

FIG. 2 illustrates a more detailed view of the back and front sides of a connector adapter according to an embodiment of the present invention. Connector adapter 110 may include housing 270 that may be manipulated by a user. A front side of connector adapter 110 may include attraction plate 240. Attraction plate 240 may include opening 250 to expose a number of contacts 260. Attraction plate 240 may be arranged to fit in a recess in a connector receptacle, for example, connector receptacle 132 located in electronic device 130 in FIG. 1. Opening 250 may be arranged to accept a mesa of the connector receptacle.

A back side of connector adapter 110 may include recess 210. Recess 210 may include a mesa 222, in which contacts 230 and 232 and located. Recess 210 may be arranged to accept an attraction plate on a connector insert, for example, a connector insert 120 attached to cable 122 in FIG. 1. Mesa 222 may be arranged to fit in an opening of the attraction plate.

Various embodiments of the present invention may provide connector adapters having components that provide for a simplified assembly procedure. Examples are shown in the following figures.

Figure 3:
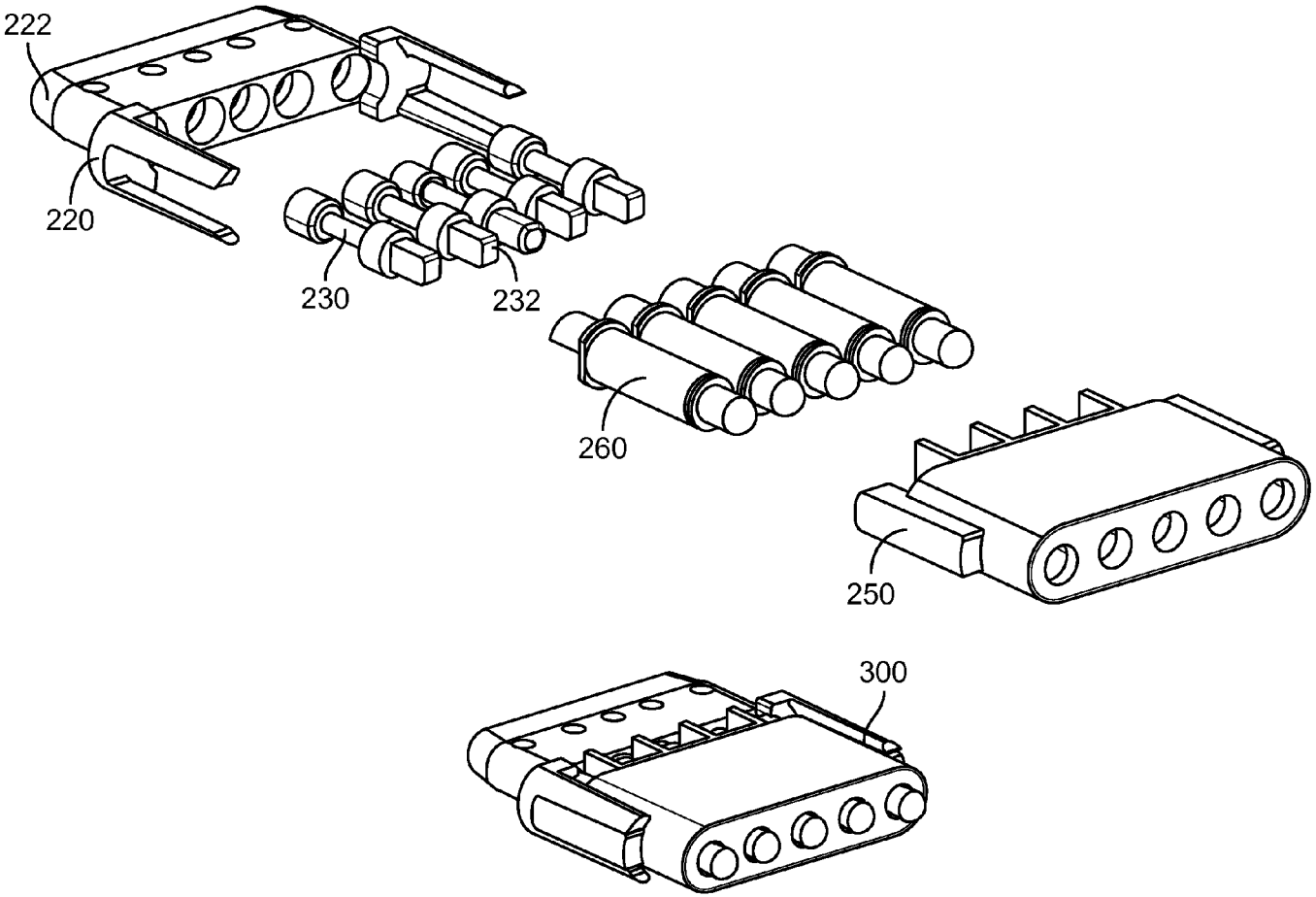
FIG. 3 illustrates a subassembly for a connector adapter according to an embodiment of the present invention.

FIG. 3 illustrates a subassembly for a connector adapter according to an embodiment of the present invention. This subassembly may include a first housing portion 220 for providing mesa 222, contacts pins 230 and signal pin 232, spring loaded contacts 260, and second housing portion 250. Contact pins 230 and signal pin 232 may be formed of brass, aluminum copper, or other material. They may be nickel plated. Also, they may be palladium-nickel plated on different portions, such as tail or contacting portions. These contacts may be formed by machining, they may be metal injection molded, stamped, formed using 3-D printing, or made using other techniques.

First housing portion 220 may be formed of plastic, glass-filled nylon, or other insulative material. First housing portion 220 may be injection molded around contacts pins 230 and 232. For example, contact pins 230 and 232 may be held in place by a fixture or injection molding tool while first housing portion 220 is molded around them.

Spring-loaded contacts 260 may be formed using brass, aluminum copper or other material. These may be nickel plated. The spring-loaded contacts 260 may further or alternately be gold-plated. Spring-loaded contacts 260 may be machine or formed using other methods.

Second housing portion 250 may be formed using plastic, glass filled nylon, or other insulative material. Second housing portion 250 may be injection molded, insert molded, formed using 3-D printing, or formed in other ways.

To assemble subassembly 300, again, first housing portion 220 may be insert molded around contacts 230 and 232. Spring-loaded contacts 260 may be inserted into passages in second housing portion 250. First housing portion 220 and second housing portion 250 may be fitted to each other. Tail portions of contacts pins 230 and 232 may be soldered or otherwise electrically connected to tail portions of spring-loaded contacts 260.

Figure 4:
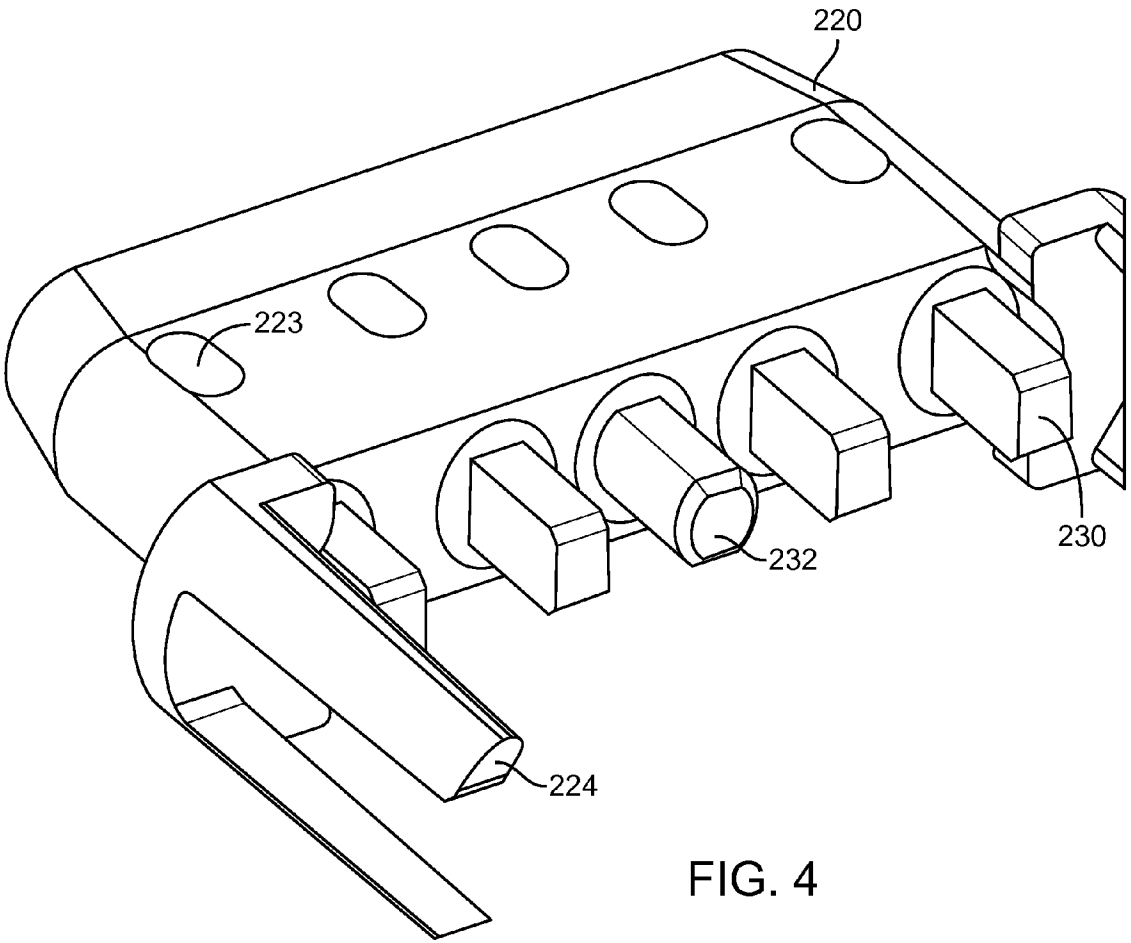
FIG. 4 illustrates a first housing portion injection molded around a number of contacts.

FIG. 4 illustrates a first housing portion injection molded around a number of contacts. Again, while the injection molding takes place, contacts 230 and 232 may be held in place, for example, by using a fixture or features of an injection molding tool. This may be done in a way that results in openings 223 being formed in first housing portion 220. Tail portions of contacts 230 and 232 may have different shapes to assist in the assembly of the connector adapter subassembly.

Figure 5:
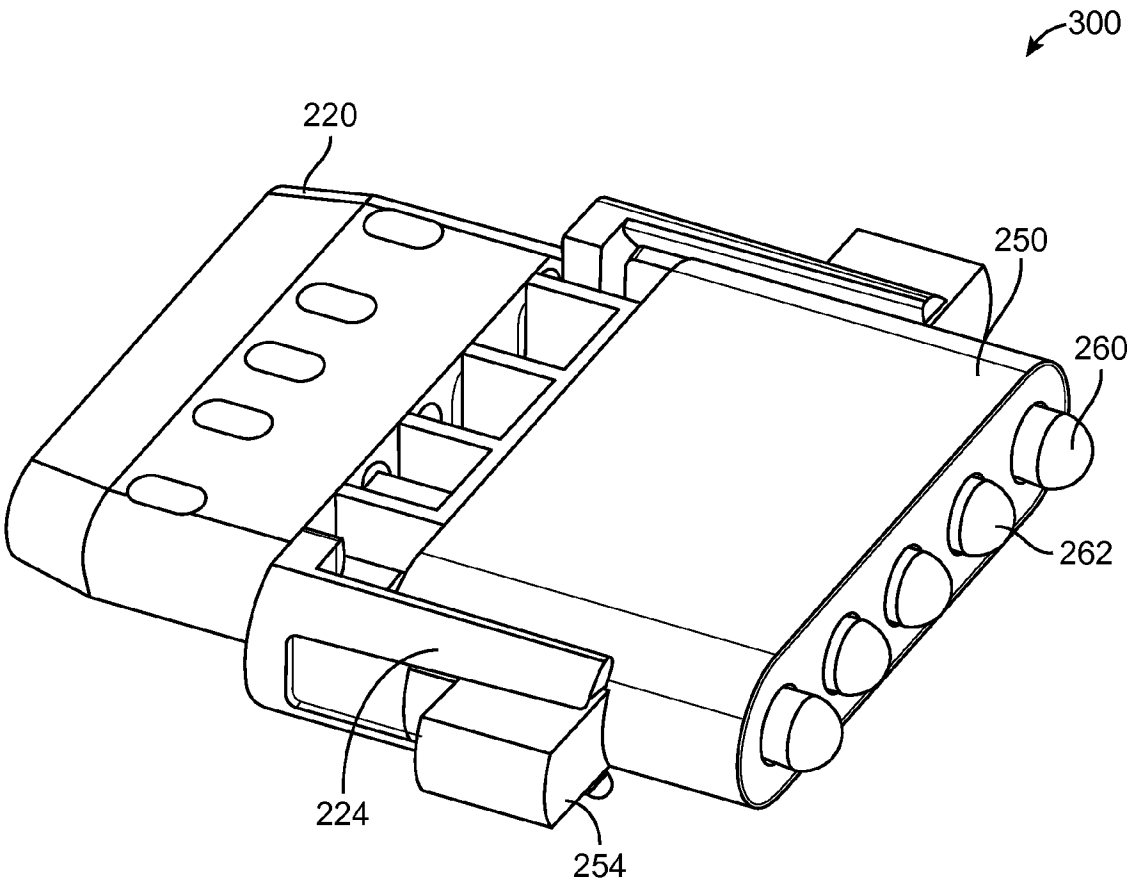
FIG. 5 illustrates an oblique view of a subassembly for a connector adapter according to an embodiment the present invention.

FIG. 5 illustrates an oblique view of a subassembly for a connector adapter according to an embodiment the present invention. Again, subassembly 300 may include first housing portion 220 and second housing portion 250. First housing portion 220 may include prongs 224. Second housing portion 250 may include tabs 254. Prongs 224 may fit around tabs 254.

In this example, subassembly 300 may include spring-loaded contacts 260 and 262. Contact 260 may extend beyond contact 262, such that when a connection is made to connector receptacle, contact 260 makes a connection with its corresponding contact before contact 262 makes contact with its corresponding contact. This may be useful when contact 260 is a ground contact. In this way a ground connection may be formed before other power or signal connections are made. For example, in one embodiment of the present invention, the outer most pins, including pin 260 may provide ground, while the next innermost pins, including pin 262, may provide power. The center pin may be used to detect that a connection between a connector insert and connector receptacle has been made.

Figure 6:
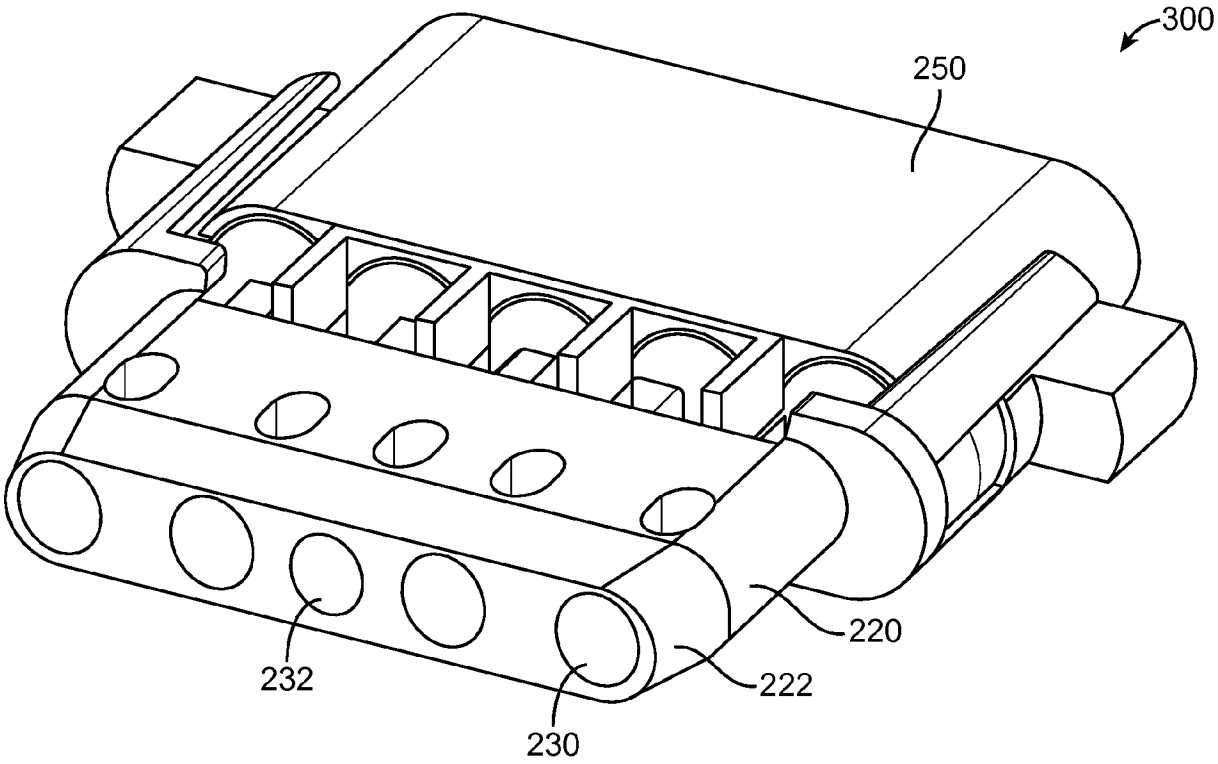
FIG. 6 illustrates another oblique view of a subassembly for a connector adapter according to an embodiment of the present invention.

FIG. 6 illustrates another oblique view of a subassembly for a connector adapter according to an embodiment of the present invention. Again, first housing portion 220 may be mated with second housing portion 250. First housing portion 220 may include mesa 222 having contacts 230 and 232.

Figure 7:
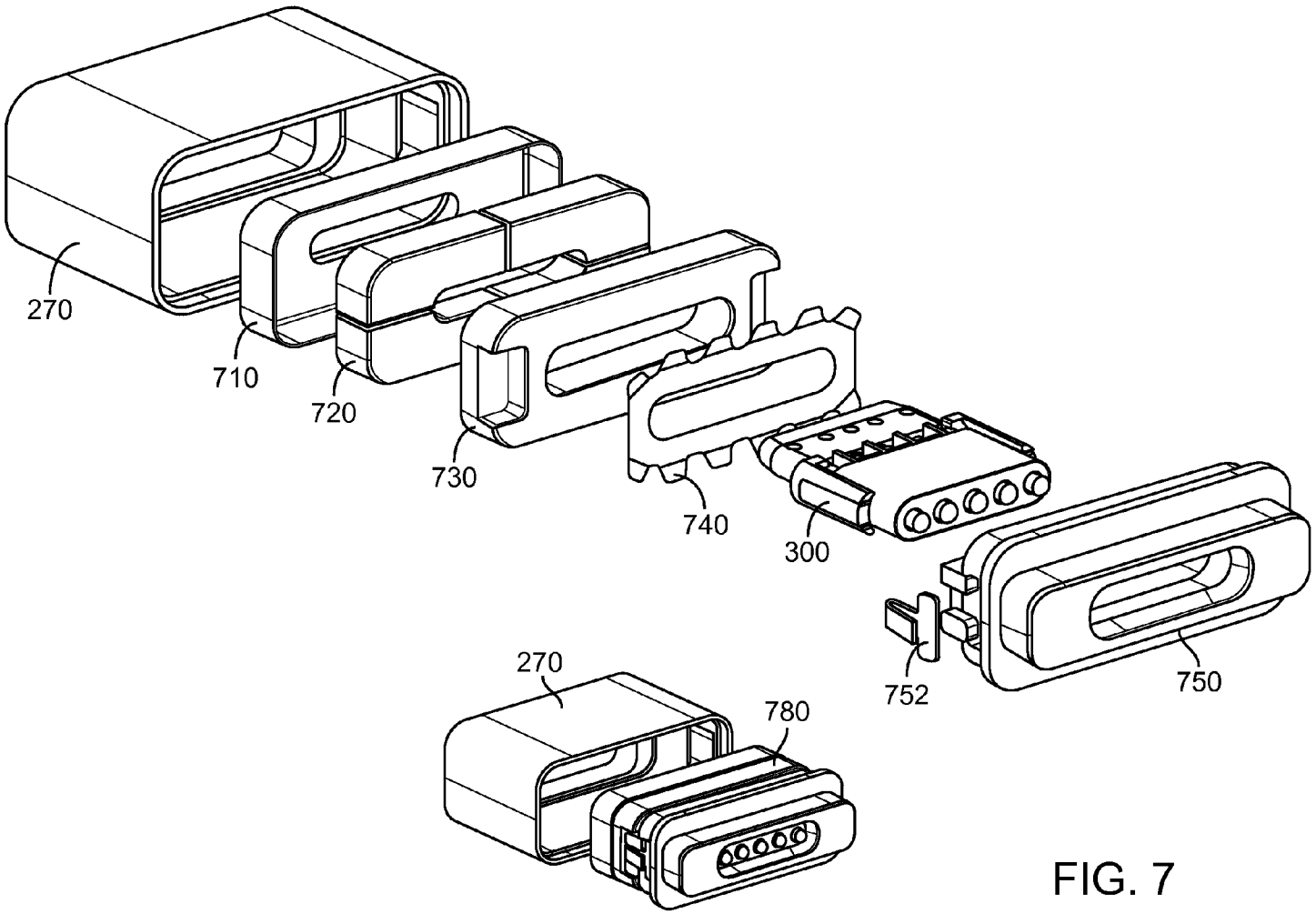
FIG. 7 illustrates components of a connector adapter according to an embodiment of the present invention.

FIG. 7 illustrates components of a connector adapter according to an embodiment of the present invention. In this example, housing 270 may be provided. Housing 270 may be formed of aluminum, plastic, ceramic, or other material. Housing 270 may be formed by extrusion and milled on a computer numerical control machine, or it may be formed using other techniques.

Face plate 710 may be inserted into housing 270. Face plate 710 may be made of stainless steel or other material. Face plate 710 may be stamped, machined, metal injection molded, or formed using other techniques. By using stainless steel for the face plate, stray magnetic flux from magnets 720 is limited. This may help to prevent magnetic damage to credit card, electrical storage devices, and other such devices and components when they come into proximity of the connector adapter.

Magnets 720 may be inserted into housing 270 behind face plate 710. Magnets 720 may include one or more magnets. For example, magnets 720 may include two, three, four, or more than four magnets. Magnets 720 may be rare-earth or other types of magnets.

Backup plate 730 may be placed in housing 270 behind magnets 720. Backup plate 730 may be formed of steel or other appropriate material. Backup plate 730 may be formed by forging, metal injection machining, or other techniques. Since backup plate 730 is made of steel, it may shunt magnetic flux between magnets 720.

Spring washer 740 may be located behind backup plate 730. Spring washer 740 may be formed of stainless steel or other appropriate material. Spring washer 740 may be stamped, metal injection molded, formed using 3-D printing, or formed using other techniques. Spring washer 740 may provide compression between attraction plate 750 and face plate 710 in order to keep the various pieces of this assembly from moving relative to each other during use.

Attraction plate 750 may be formed of steel, such as steel 1010. Attraction plate 750 may be formed by metal injection molding, machining, 3-D printing, stamping, or other appropriate technique.

Subassembly 300 may be inserted into openings in spring washer 740, backup plate 730, magnets 720, and face plate 710.

Locking clips 752 may be spot or laser welded, soldered, or fixed by other appropriate technique to attraction plate 750. Attraction plate 750 may then be inserted into housing 270. Locking clips 752 may retract, and then expand when they reach corresponding grooves or cutouts in housing 270, thereby fixing attraction plate 750 into position in housing 270. Attraction plate 750 may further be fixed into position in housing 270 by using an adhesive, such as epoxy resin, or other appropriate agent. This may further help control offsets between these components and thus the cosmetic appearance of the connector adapter.

In various embodiments of the present invention, spacing between contacts in a receptacle side of a connector adapter may be different than spacing between contacts in an insert side. It may also be desirable to position contacting ends of one or more contacts ahead of one or more other contacts, as was shown in FIG. 5. However, it may also be desirable to avoid complicated interconnections between contacts on a receptacle side and contacts on insert side. Accordingly, embodiments of the present invention may provide contacts having sufficiently large tail portions that they may be electrically connected in various locations to other contacts to compensate for these differences in pitch and depth. An example is shown in the following figure.

Figure 8:
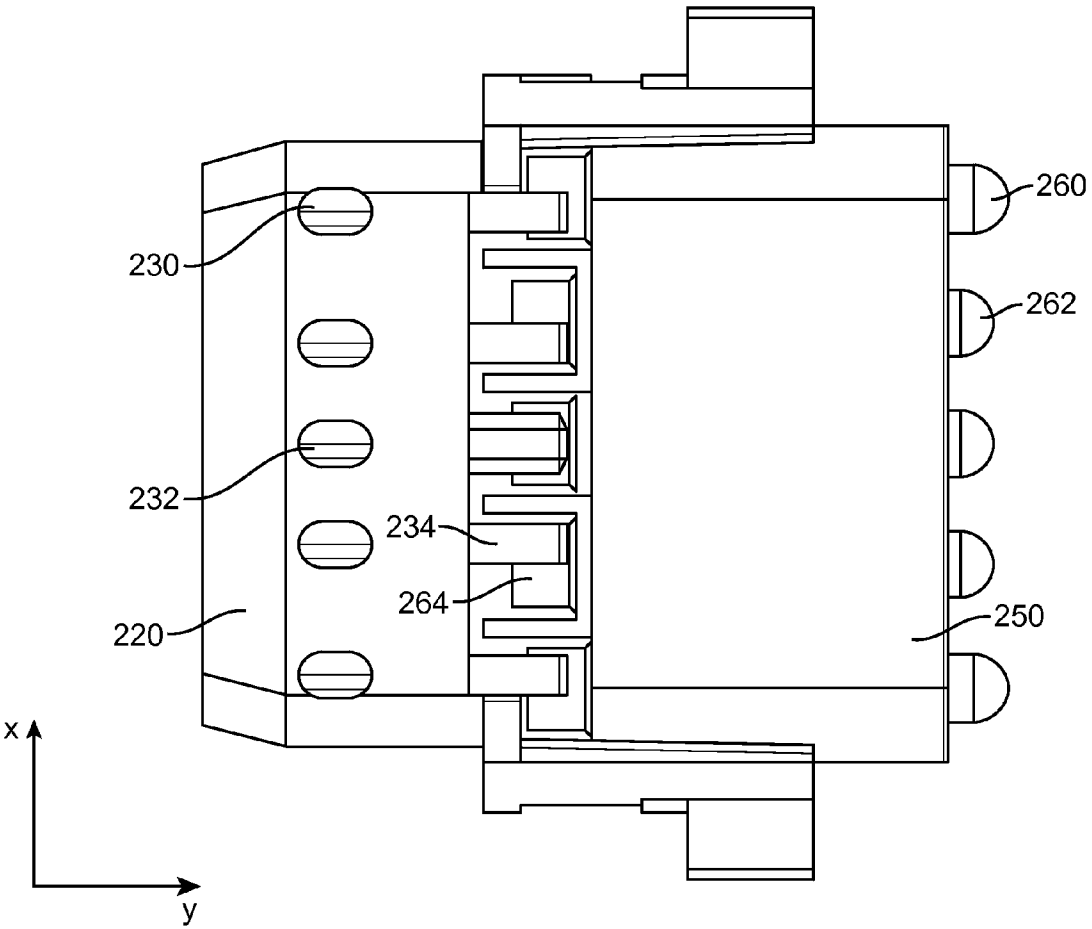
FIG. 8 illustrates a more detailed view of connections between contacts and a subassembly for a connector adapter according to an embodiment of the present invention.

FIG. 8 illustrates a more detailed view of connections between contacts and a subassembly for a connector adapter according to an embodiment of the present invention. In this example, contacts 230 and 232 reside on a receptacle side, while contacts 260 and 262 reside on an insert side. Contacts 260 and 262 may include tail portions 264, while contacts 230 may include tail portions 234. Tail portions 234 may contact tail portions 264 in various positions. This may allow contacts 230, having a narrower pitch, to directly connect to contacts 260, which may have a wider pitch, without a complicated interconnect. Also, contact 260 may be moved forward relative to contact 262, as shown. In this way, contacts 260 and 262 may be the same or similar spring-loaded contacts.

In various embodiments of the present invention, the adaptation from a connector insert to a connector receptacle may be done using a cable assembly or boggle. An example is shown in the following figures.

Figure 9:
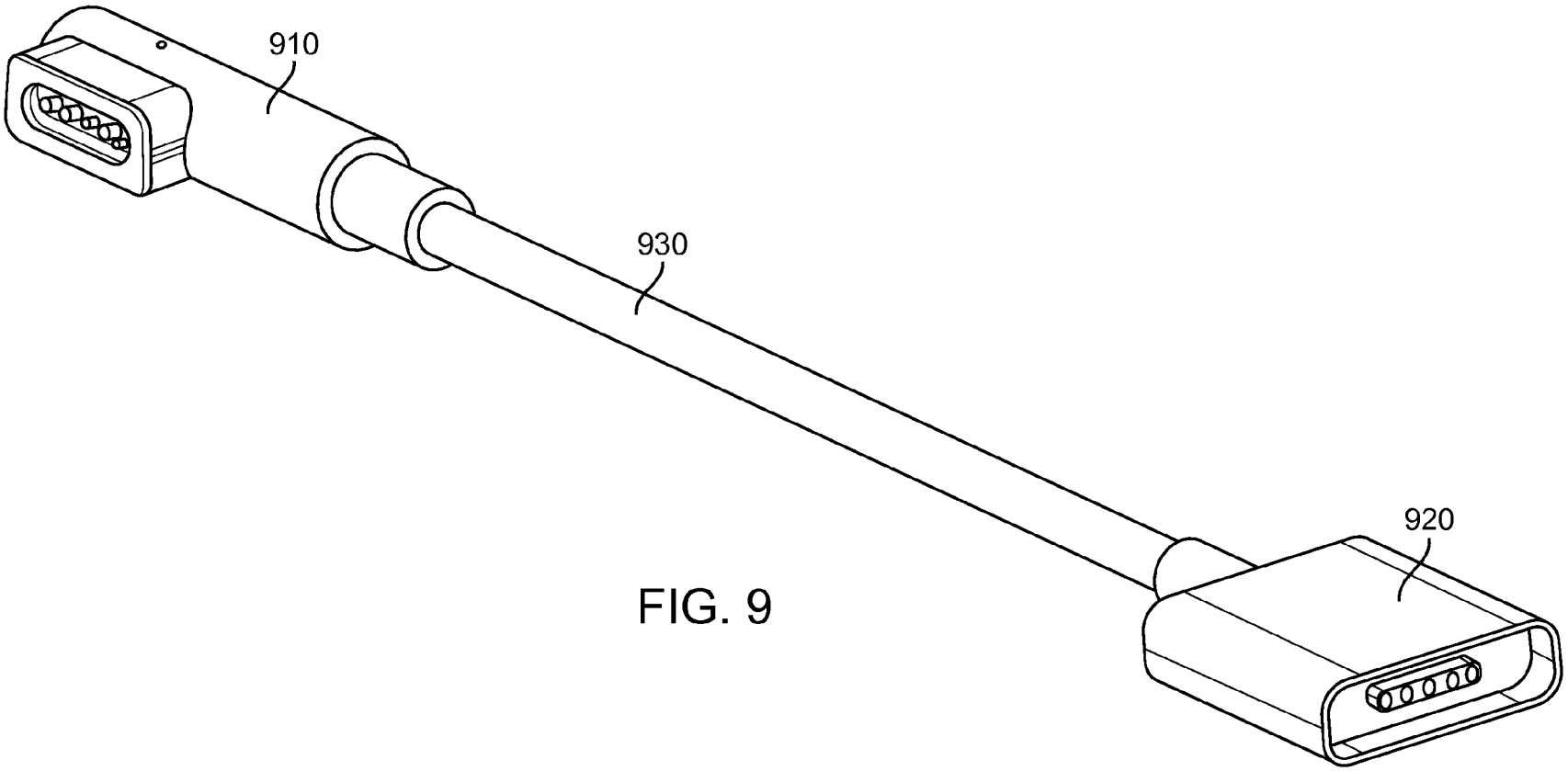
FIG. 9 illustrates a cable assembly according to an embodiment of the present invention.

FIG. 9 illustrates a cable assembly according to an embodiment of the present invention. This cable assembly includes connector insert 910, connector receptacle 920, and cable 930. As before, a connector insert may be inserted into connector receptacle 920, while connector insert 910 may be inserted into an otherwise incompatible connector receptacle.

Figure 10:
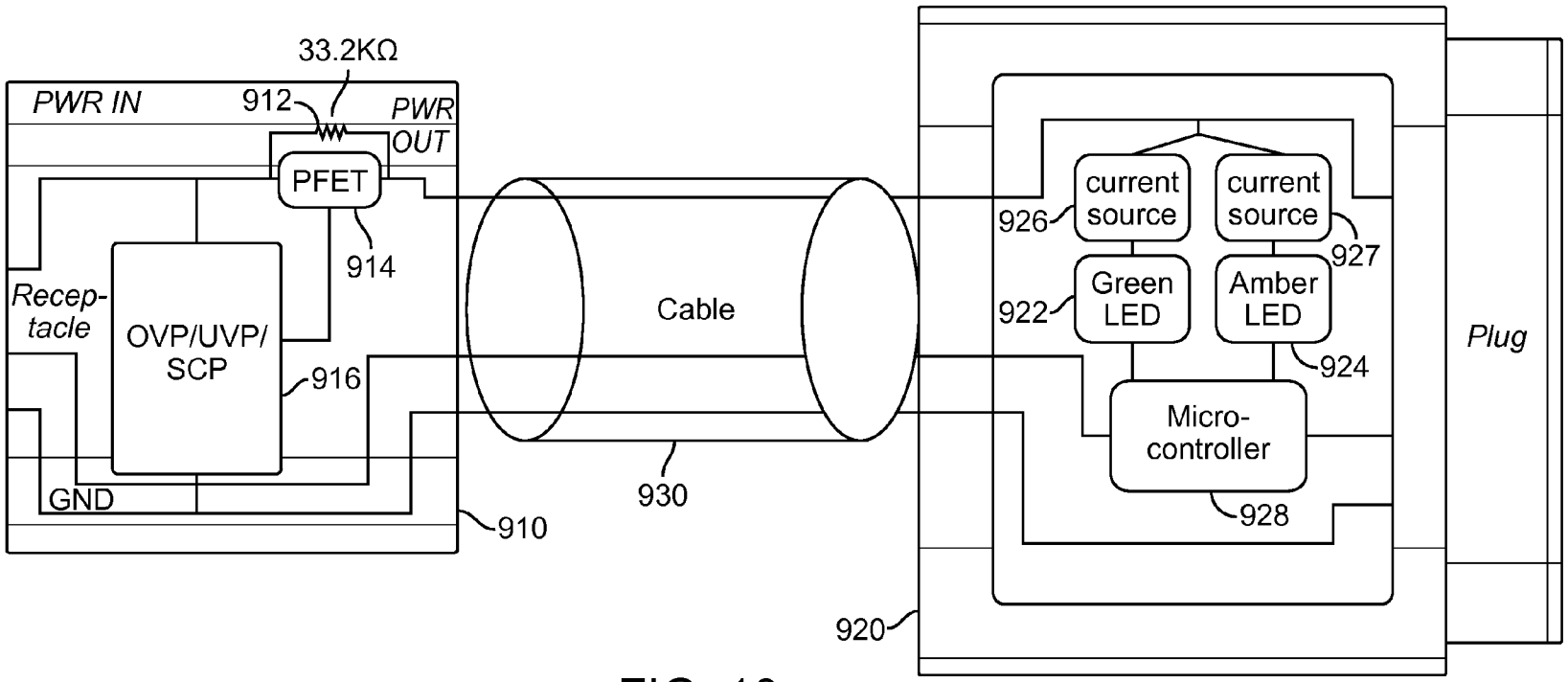
FIG. 10 illustrates electronic circuitry that may be included in a cable assembly according to an embodiment of the present invention.

FIG. 10 illustrates electronic circuitry that may be included in a cable assembly according to an embodiment of the present invention. Connector receptacle 910 may include a current limiting device 912. Current limiting device 912 may be a resistor. Current limiting device 912 may provide protection from large currents until connector insert 920 is inserted into a proper receptacle. Bypass transistors 914 may bypass current limiting device 912 once it is established that connector insert 920 is inserted into a proper receptacle.

Connector insert 920 may provide indications that a connection has been made and that charging is occurring. Accordingly, connector insert 920 may provide light-emitting diodes 932 and 924. These light-emitting diodes may be driven by current sources 926 and 927. Current sources 922 and 24 may be controlled by microcontroller 928. Further examples of the circuitry in receptacle 910 and insert 920, and their operation, can be found in co-pending U.S. patent application Ser. No. 13/286,982, filed Nov. 1, 2011, titled TIME-DOMAIN MULTIPLEXING OF POWER AND DATA, which is incorporated by reference.

In the above description of embodiments of the present invention, various examples are given for materials and methods of manufacturing used. It should be recognized that these are examples and not exhaustive lists. For example, techniques, such as 3-D printing, may be used to form most any of the above-described components.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. A connector adapter comprising:

a subassembly comprising:

a first housing portion having a first number of passages and forming a raised surface;

a first number of contact pins spaced having a first pitch, each having a contacting end and a tail end, each located in a passage in in the first housing portion;

a second housing portion having the first number of passages; and a first number of spring-loaded contacts spaced having a second pitch, the first pitch different from the first pitch, each having a contacting end and a tail end, each located in a passage in the second housing portion, wherein a tail end of each first number of contact pins is electrically and directly connected to a tail end of a corresponding one of the first number of spring-loaded contacts;

an outer housing at least substantially surrounding the subassembly and having a front opening and a back opening;

an attraction plate fit into the front opening of the outer housing and having an opening to provide access to the contacting ends of the spring-loaded contacts; and a face plate fit into the back opening of the outer housing and having an opening to provide access to the contacting ends of the contact pins.

2. A connector adapter comprising:

a subassembly comprising:

a first housing portion having a first number of passages and forming a raised surface;

a first number of contact pins, each having a contacting end and a tail end, each located in a passage in in the first housing portion;

a second housing portion having the first number of passages; and a first number of spring-loaded contacts, each having a contacting end and a tail end, each located in a passage in the second housing portion, wherein a tail end of each first number of contact pins is electrically and directly connected to a tail end of a corresponding one of the first number of spring-loaded contacts;

an outer housing at least substantially surrounding the subassembly and having a front opening and a back opening;

an attraction plate fit into the front opening of the outer housing and having an opening to provide access to the contacting ends of the spring-loaded contacts; and a face plate fit into the back opening of the outer housing and having an opening to provide access to the contacting ends of the contact pins.

3. The connector adapter of claim 2 further comprising:

a first locking clip and a second locking clip on sides of the attraction plate, wherein the first locking clip and the second locking clip fix the attraction plate to the outer housing.

4. The connector adapter of claim 3 further comprising:

a plurality of magnets located behind the face plate.

5. The connector adapter of claim 4 further comprising:

a backup plate located behind the plurality of magnets.

6. The connector adapter of claim 5 further comprising:

a spring washer between the backup plate and the attraction plate.

7. The connector adapter of claim 6, wherein the backup plate and spring washer each include an opening to accept the subassembly.

8. The connector adapter of claim 1 further comprising:

a plurality of magnets located behind the face plate.

9. A method of assembling a connector adapter comprising:

forming a subassembly to be inserted into an outer housing for the connector adapter by:

receiving a plurality of contact pins, each having a contacting end and a tail end;

forming a first housing portion around the plurality of contact pins, the first housing portion including a raised surface;

receiving a plurality of spring-loaded contacts, each having a contacting end and a tail end;

receiving a second housing portion;

inserting the plurality of spring-loaded contacts into the second housing portion;

electrically connecting a tail end of each of the plurality of contact pins to a tail end of a corresponding one of the plurality of spring-loaded contacts; and fitting a face plate into an opening of the outer housing.

10. The method of claim 9 further comprising:

fitting a plurality of magnets behind the face plate in the outer housing.

11. The method of claim 10 further comprising:

fitting a backup plate behind the plurality of magnets in the outer housing.

12. The method of claim 11 further comprising:

fitting a spring washer behind the backup plate in the outer housing.

13. The method of claim 12 further comprising:

fitting the subassembly though openings in the spring washer, the backup plate, the plurality of magnets, and the face plate.

14. The method of claim 13 further comprising:

attaching a first locking clip and a second locking clip to sides of an attraction plate; and fitting the attraction plate to the outer housing such that the first locking clip and the second locking clip fix the attraction plate relative to the outer housing.

15. The connector adapter of claim 2 wherein a first lateral spacing between at least two of the first number of contact pins is different than a second lateral spacing between at least two of the first number of spring-loaded contacts, wherein to compensate for a difference between the first lateral spacing and the second lateral spacing, a tail portion of a first contact in the first number of contact pins electrically connects to a tail portion of a first contact in the first number of spring-loaded contacts at a first lateral position and a second contact in the first number of contact pins electrically connects to a tail portion of a second contact in the first number of spring-loaded contacts at a lateral second position, the first lateral position different than the second lateral position.

16. A connector adapter comprising:

a receptacle side having a first plurality of contacts, each having a contacting portion and a tail portion;

an insert side having a second plurality of contacts, each having contacting portion and a tail portion, wherein a first lateral spacing between at least two of the first plurality of contacts is different than a second lateral spacing between at least two of the second plurality of contacts, wherein a tail portion of each contact in the first plurality of contacts electrically connects to a tail portion of a corresponding contact in the second plurality of contacts;

wherein to compensate for a difference between the first lateral spacing and the second lateral spacing, a tail portion of a first contact in the first plurality of contacts electrically connects to a tail portion of a first contact in the second plurality of contacts at a first lateral position and a second contact in the first plurality of contacts electrically connects to a tail portion of a second contact in the second plurality of contacts at a lateral second position the first lateral position different than the second lateral position, wherein a tail portion of a third contact in the first plurality of contacts connects to a tail portion of a third contact in the second plurality of contacts at a first depth that is different than a second depth that a fourth contact in the first plurality of contacts connects to a tail portion of a fourth contact in the second plurality of contacts, such that a contacting portion of the third contact in the second plurality of contacts extends beyond a contacting portion of the fourth contact in the second plurality of contacts.

17. The connector adapter of claim 16, wherein the second plurality of contacts are spring-loaded contacts.

18. The connector adapter of claim 15 wherein a tail portion of a third contact in the first number of contact pins connects to a tail portion of a third contact in the first number of spring-loaded contacts at a first depth that is different than a second depth that a fourth contact in the first number of contact pins connects to a tail portion of a fourth contact in the first number of spring-loaded contacts, such that a contacting portion of the third contact in the first number of spring-loaded contacts extends beyond a contacting portion of the fourth contact in the first number of spring-loaded contacts.

19. The connector adapter of claim 1 wherein a first lateral spacing between at least two of the first number of contact pins is different than a second lateral spacing between at least two of the first number of spring-loaded contacts, wherein to compensate for a difference between the first lateral spacing and the second lateral spacing, a tail portion of a first contact in the first number of contact pins electrically connects to a tail portion of a first contact in the first number of spring-loaded contacts at a first lateral position and a second contact in the first number of contact pins electrically connects to a tail portion of a second contact in the first number of spring-loaded contacts at a lateral second position, the first lateral position different than the second lateral position.

20. The connector adapter of claim 19 wherein a tail portion of a third contact in the first number of contact pins connects to a tail portion of a third contact in the first number of spring-loaded contacts at a first depth that is different than a second depth that a fourth contact in the first number of contact pins connects to a tail portion of a fourth contact in the first number of spring-loaded contacts, such that a contacting portion of the third contact in the first number of spring-loaded contacts extends beyond a contacting portion of the fourth contact in the first number of spring-loaded contacts.

* * * * *

UNITED STATES PATENT AND TRADEMARK OFFICE

CERTIFICATE OF CORRECTION

PATENT NO. : 9,209,547 B2
APPLICATION NO. : 13/492608
DATED : December 8, 2015
INVENTOR(S) : Villarreal et al.

It is certified that error appears in the above-identified patent and that said Letters Patent is hereby corrected as shown below:

On the Title Page item [75]

Delete "Jim Smeenge" and insert --James G. Smeenge--.

Delete "Chiew-Sang Goh" and insert --Chiew-Siang Goh--.

In the Claims

Column 9, Line 24, Claim 16: delete "position the" and insert --position, the--.

Signed and Sealed this
Twenty-ninth Day of March, 2016

Michelle K. Lee

Michelle K. Lee
*Director of the United States Patent and Trademark Office*